US010557094B2

(12) United States Patent
Rawat et al.

(10) Patent No.: US 10,557,094 B2
(45) Date of Patent: Feb. 11, 2020

(54) CRUDE UNIT OVERHEAD CORROSION CONTROL USING MULTI AMINE BLENDS

(71) Applicant: BHARAT PETROLEUM CORPORATION LTD., Greater Noida (IN)

(72) Inventors: Jaya Rawat, Greater Noida (IN); Ankur Verma, Greater Noida (IN); D. T. Gokak, Greater Noida (IN); Sanjay Bhargava, Greater Noida (IN)

(73) Assignee: BHARAT PETROLEUM CORPORATION LTD., Greater Noida (IN)

( * ) Notice: Subject to any disclaimer, the term of this patent is extended or adjusted under 35 U.S.C. 154(b) by 319 days.

(21) Appl. No.: 15/596,240

(22) Filed: May 16, 2017

(65) Prior Publication Data

US 2017/0335210 A1 Nov. 23, 2017

(30) Foreign Application Priority Data

May 18, 2016 (IN) ..... 201611017156

(51) Int. Cl.

| | |
|---|---|
| ***B08B 9/00*** | (2006.01) |
| ***C23F 11/00*** | (2006.01) |
| ***C23F 11/04*** | (2006.01) |
| ***C10G 75/02*** | (2006.01) |

(52) U.S. Cl.

CPC ..... *C10G 75/02* (2013.01)

(58) Field of Classification Search

CPC ..... C10G 75/02
USPC ..... 422/7, 12, 16; 134/22.1, 22.14
See application file for complete search history.

(56) References Cited

U.S. PATENT DOCUMENTS

| | | | | |
|---|---|---|---|---|
| 4,335,072 | A | 6/1982 | Barnett et al. | |
| 5,164,110 | A * | 11/1992 | Haraer | C23F 11/08 252/188.28 |
| 5,211,840 | A | 5/1993 | Lehrer et al. | |
| 5,425,267 | A | 6/1995 | Herrmann et al. | |
| 5,714,664 | A | 2/1998 | Fearnside et al. | |
| 5,965,785 | A | 10/1999 | Braden et al. | |
| 7,381,319 | B2 * | 6/2008 | Lack | C10G 7/10 208/47 |
| 2006/0043340 | A1 | 3/2006 | Koizumi et al. | |

* cited by examiner

*Primary Examiner* — Monzer R Chorbaji
(74) *Attorney, Agent, or Firm* — Oliff PLC

(57) ABSTRACT

A method for inhibiting corrosion on internal metal surfaces of an overhead condenser of a crude distillation unit in which hydrocarbons, water and amine hydrochlorides condense, the method includes adding to the overhead condenser an amine composition in an amount and at a rate sufficient to maintain the pH of water condensate in the condenser above a pH of about 5, the amine composition made of a mixture of four amines wherein the amines are monoethanloamine, methoxypropyl amine, morpholine and cyclohexylamine present in a weight ratio ranging from about 25:30:25:20 to about 30:40:15:15. Further, a system and method assess the corrosion rate and optimize the dosage of neutralizing amine composition during the operating conditions of overhead condensing system.

9 Claims, 8 Drawing Sheets

300

400

500

600

700

800

CRUDE UNIT OVERHEAD CORROSION CONTROL USING MULTI AMINE BLENDS

FIELD OF THE INVENTION

The present disclosure pertains to technical field of refinery processing of crude oil. In particular, the present disclosure pertains to inhibiting corrosion of overhead equipment of a distillation unit in petroleum refinery.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

Hydrocarbon feed stocks such as petroleum crudes, gas oil, etc. are subjected to various processes in order to isolate and separate different fractions of the feedstock. The lower boiling fractions, including naphtha, from which gasoline is derived, are recovered as an overhead fraction from the distillation column. The fractions with intermediate volatility are withdrawn from the distillation column as sidestreams. Sidestream products include kerosene, jet fuel, diesel fuel, and gas oil. The overhead and sidestream products are cooled, condensed and sent to other units to be processed into final products.

The distillation equipment is liable to corrosive activity of acids such as HCl, $H_2S$, organic acids, and $H_2CO_3$. HCl, the most troublesome corrosive material, is formed by hydrolysis of calcium and magnesium chlorides originally present in crude oils. The problem of corrosion caused by these acidic components as water condenses in the overhead condensing system of distillation columns. The water condensate formed contains a significant concentration of these acidic components, and high concentrations of the same render the pH of the water condensate highly acidic and, of course, dangerously corrosive. Accordingly, neutralizing treatments have been used to render the pH of the condensate alkaline to thereby minimize acid-based corrosive attack at those regions of the apparatus with which this condensate is in contact.

The rate of corrosion is directly related to the concentration of hydrogen ions in the water condensate. A particularly difficult aspect of the problem is that corrosion occurs above and in the temperature range of the initial condensation of water. The term "initial condensate" as used herein indicates a phase formed when the temperature of the surrounding environment reaches the dew point of water. At this point a mixture of liquid water, hydrocarbon, and vapor may be present. Such initial condensate may occur within the distilling column itself or in subsequent columns. The top temperature of the fractionating column is normally maintained above the dew point of water. The initial water condensate formed contains a high percentage of HCl. Due to high concentration of acids dissolved in the water, the pH of the first condensate is quite low and the condensed water is highly corrosive.

Several treatment methods using different types of amines, including highly basic amines, have been proposed in the art to control or inhibit corrosion that ordinarily occurs at the point of initial condensation within or after the distillation unit. However, treatment methods utilizing the known amines have not been successful and specific problems have been reported in connection with the use of these amines for treating the initial condensate. For example, U.S. Pat. No. 7,381,319 states that use of highly basic amines such as, morpholine, methoxypropylamine, ethylenediamine, monoethanolamine, hexamethylenediamine, etc. for treating the initial condensate has a problem relating to the resultant hydrochloride salts of these amines which tend to form deposits in various parts of the distillation unit and thereby cause both fouling and under-deposit corrosion problems.

The inability of some neutralizing amines to condense at the dew point of water tend to form a highly corrosive initial condensate and thereby leads to formation of hydrochloride or sulfide salts of those neutralizing amines on metallic surfaces of the distillation columns. The salts appear before the dew point of water result in fouling and under-deposit corrosion, often referred to as "dry" corrosion.

Further, it is difficult to assess the corrosion rate and determining the required dosage of amines during the operating conditions of overhead condensing system. Traditional treatment methods optimize the amine dosage depending on boot water pH, chloride and iron counts, but these methods do not provide information as to optimal dosage of amines for system conditions.

There is thus a need in the art for a new and improved neutralizing agent that facilitates effective neutralization of acidic components at the point of initial condensation and/or minimizes or eliminates deposits of salts on metal surfaces of distillation columns and thereby avoids formation of fouling and under-deposit corrosion. Also, there is a need in the art for a system and method to assess the corrosion rate and to optimize the dosage of neutralizing agents during the operating conditions of overhead condensing system.

The present invention satisfies the existing needs, as well as others, and generally overcomes the deficiencies found in the prior art.

OBJECTS OF THE INVENTION

It is an object of the present disclosure to provide a neutralizing agent for efficiently neutralizing acidic components in overhead condensing system of distillation columns to inhibit corrosion of the same.

It is a further object of the present disclosure to provide a neutralizing agent for efficiently neutralizing acidic components at the point of initial condensation of water in overhead condensing system.

It is another object of the present disclosure to provide a neutralizing agent for efficiently neutralizing acidic components in overhead condensing system while preventing deposits of unwanted salts on metallic surfaces thereof.

It is another object of the present disclosure to provide a method for inhibiting corrosion in overhead condensing system of distillation columns.

It is another object of the present disclosure to provide a method for eliminating or minimizing deposits of unwanted salts on metallic surfaces of overhead condensing systems.

It is another object of the present disclosure to provide a method for assessing corrosion rate and optimizing dosage of neutralizing agents during operating conditions of overhead condensing system.

SUMMARY OF THE INVENTION

The present disclosure provides a method for inhibiting corrosion on internal metal surfaces of an overhead condenser of a crude distillation unit in which hydrocarbons, water and amine hydrochlorides condense, the method comprising adding to the overhead condenser an amine composition in an amount and at a rate sufficient to maintain the pH of water condensate in the condenser above a pH of about 5-6.5, the amine composition consisting of a mixture of monoethanloamine, methoxypropyl amine, morpholine and cyclohexylamine in a weight ratio (vol %) ranging from about 25:30:25:20 to about 30:40:15:15.

The present disclosure provides a method for inhibiting corrosion on internal metal surfaces of an overhead condenser of a crude distillation unit during fractionation of a mixture comprising hydrocarbons, water and amine hydrochlorides, wherein the condenser has an upper condensing zone which operates at temperatures below the water dew point of the mixture and a lower condensing zone which operates at temperatures above the water dew point of the mixture, the method comprising: adding to the condenser in the upper condensing zone an amine composition in an amount sufficient to maintain the pH of water condensate in the condenser above a pH of about 5-6.5, wherein the amine composition consists of a mixture of monoethanloamine, methoxypropyl amine, morpholine and cyclohexylamine in a weight ratio (vol %) ranging from about 10:20:40:30 to about 5:15:30:50.

According to one embodiment of the present disclosure, the method for inhibiting corrosion on internal metal surfaces of an overhead condenser of a crude distillation unit can utilize an overhead corrosion simulator to assess corrosion as a function of pH and chloride concentration.

In yet another embodiment of the present disclosure, the method for inhibiting corrosion on internal metal surfaces of an overhead condenser of a crude distillation unit can utilize an electrochemical method for prediction of corrosion rate.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE INVENTION

Figure 1:
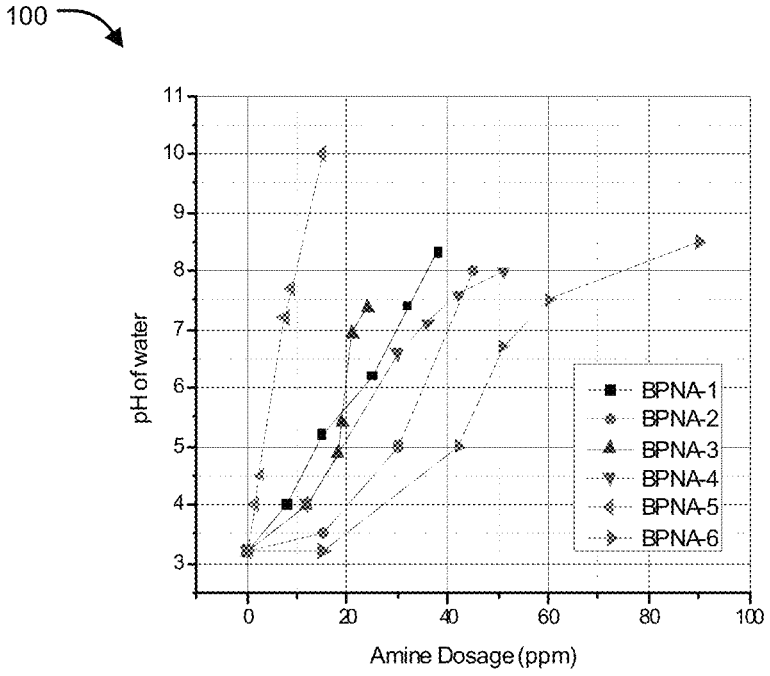
FIG. 1 is a graph illustrating neutralizing capacity of six amine compositions at 50 ppm chloride concentration in accordance with embodiments of the present disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follow, the word "comprise" and variations thereof such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The recitation of ranges of values herein is merely intended to serve as a shorthand method of referring individually to each separate value falling within the range.

Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The headings and abstract of the invention provided herein are for convenience only and do not interpret the scope or meaning of the embodiments.

Reference will now be made in detail to the exemplary embodiments of the present invention, examples of which are illustrated in the accompanying drawings. Wherever possible, the same reference numbers are used in the drawings and the description to refer to the same or like parts.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Various terms as used herein are shown below. To the extent a term used in a claim is not defined below, it should be given the broadest definition persons in the pertinent art have given that term as reflected in printed publications and issued patents at the time of filing.

In one aspect, the present disclosure provides a method for inhibiting corrosion on internal metal surfaces of an overhead condenser of a crude distillation unit in which hydrocarbons, water and amine hydrochlorides condense, the method comprising adding to the overhead condenser an amine composition in an amount and at a rate sufficient to maintain the pH of water condensate in the condenser above a pH of about 5, the amine composition consisting of a mixture of monoethanloamine, methoxypropyl amine, morpholine and cyclohexylamine in a weight ratio (vol %) ranges from about 10:20:40:30 to about 5:15:30:50.

As used herein, the term "corrosion inhibition" can refer to any cessation, prevention, abatement, reduction, suppression, lowering, controlling or decreasing of corrosion, rusting, oxidative decay, etc. Similarly, the term "neutralize" can refer to such corrosion inhibition by reducing the acidity of the chemicals or components in the overhead condensing systems by raising pH from acidity to basicity to some measurable extent. Furthermore, the nature of the metal surfaces protected in the methods of this disclosure is not limited and may include iron alloys, copper alloys, nickel alloys, titanium alloys, and these metals in unalloyed form as well, etc.

Figure 4:
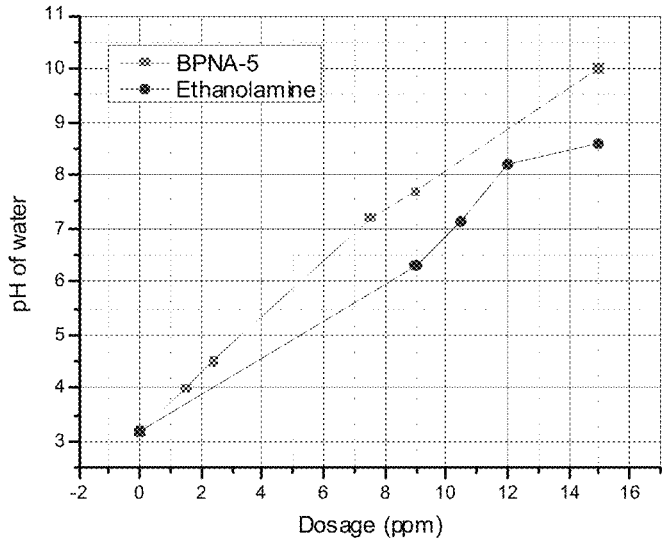
FIG. 4 is a graph illustrating neutralizing capacity of an amine composition of the present disclosure against ethanolamine at 50 ppm chloride concentration.
Figure 5:
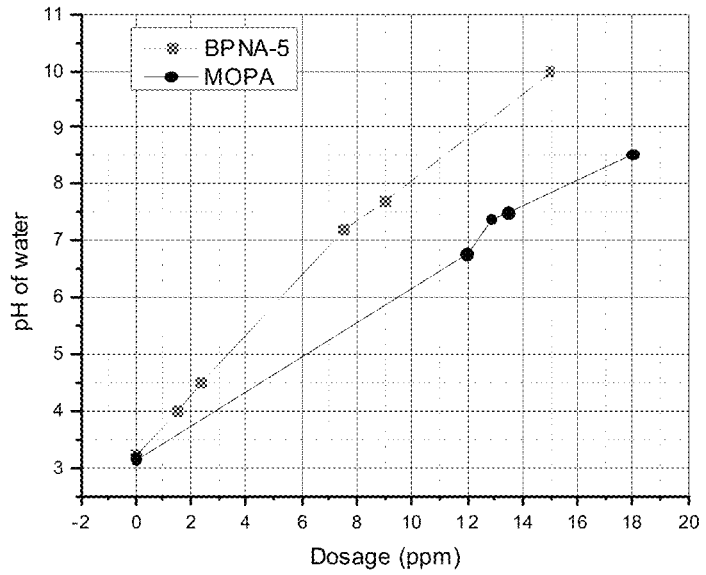
FIG. 5 is a graph illustrating neutralizing capacity of an amine composition of the present disclosure against methoxypropyl amine (MOPA) at 50 ppm chloride concentration.

The amine composition of the present disclosure is a mixture of four amines wherein the amines can be monoethanloamine, methoxypropyl amine, morpholine and cyclohexylamine. This amine composition can have relatively stronger basicity and can be more resistant to hydrochloride salt formation than currently used amine neutralizers. The amine composition can be optimally custom formulated with different weight ratios of the amine components to achieve the desired pH elevation to corrosion protect the overhead condensing systems of distillation columns. The amine composition of the present disclosure can facilitate greater neutralization of corrosive acids in overhead condensing systems without increasing the potential to form corrosive salts with hydrogen chloride. FIG. 4 and FIG. 5 depict neutralizing capacity of the amine composition against ethanolamine and methoxypropyl amine (MOPA) at 50 ppm chloride concentration in accordance with embodiments of the present disclosure.

In an exemplary embodiment, the weight ratio of morioethanloamine, methoxypropyl amine, morpholine and cyclohexylamine can preferably be about 10:20:40:30 to about 5:15:30:50 respectively by weight of total weight of the amine composition.

The amine composition of the present disclosure can elevate pH of the water condensate to corrosion-safe levels across the entire condensation zone, from the point of initial water condensation, where highest chloride concentrations and lowest pH's are observed, through to the overhead condensate drums where the overhead is totally condensed and bulk sour water is accumulated, and at all intermediate water condensation points in the system. The amine blends (compositions) of the present disclosure behaves as mixed type inhibitors i.e., they can retard the corrosion reaction by blocking both anodic and cathodic sites of the metal.

The amine composition may be added to the overhead condenser system at a rate sufficient to maintain the pH of water condensate in the condenser at a pH of about 5.0 or higher. The desired pH range for all points in the overhead condenser can range from about 5 to about 7.5, and preferably range from about 5 to about 6.5. The amount of amine composition may range from about 1 to about 10,000 ppm, based on the amount of water condensate. In an exemplary embodiment, the amount of amine composition may range from about 10 to about 200 ppm.

Figure 2:
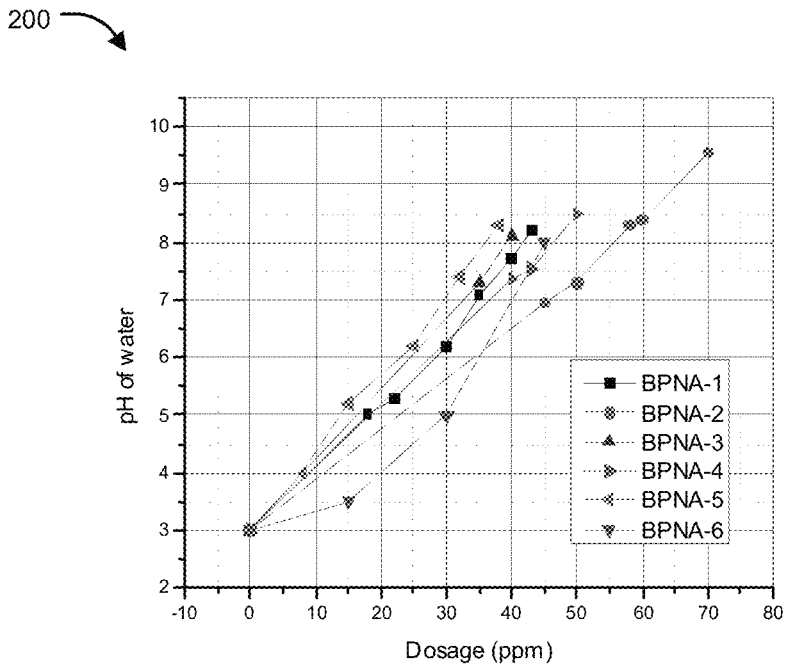
FIG. 2 is a graph illustrating neutralizing capacity of six amine compositions at 100 ppm chloride concentration in accordance with embodiments of the present disclosure.
Figure 3:
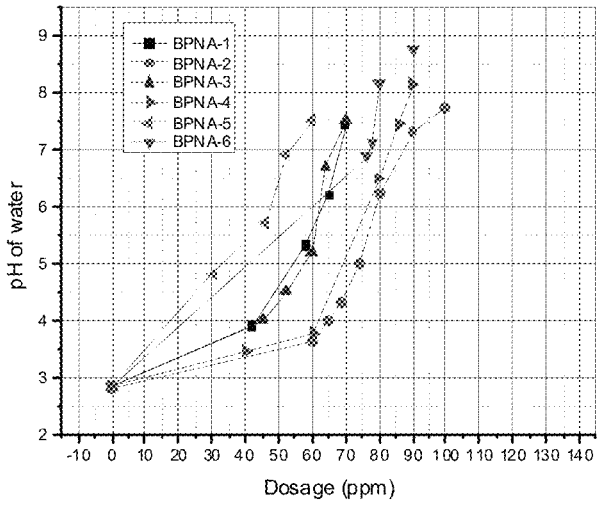
FIG. 3 is a graph illustrating neutralizing capacity of six amine compositions at 200 ppm chloride concentration in accordance with embodiments of the present disclosure.

The amine composition of the present disclosure, in small amounts, can effectively elevate pH of the water condensate to corrosion-safe levels and thereby reduce the cost of the treatment, eliminate operating problems due to high amine concentrations in downstream units, and mitigate or inhibit deposition of amine hydrochloride salt. FIGS. 1, 2 and 3 illustrate neutralizing capacity of different amine compositions at 50 ppm, 100 ppm and 200 ppm chloride concentration respectively, in accordance with embodiments of the present disclosure. Further, the amine composition(s) can be suitable for overhead condensing systems with water wash provision and also for systems without water wash provision.

Figure 6:
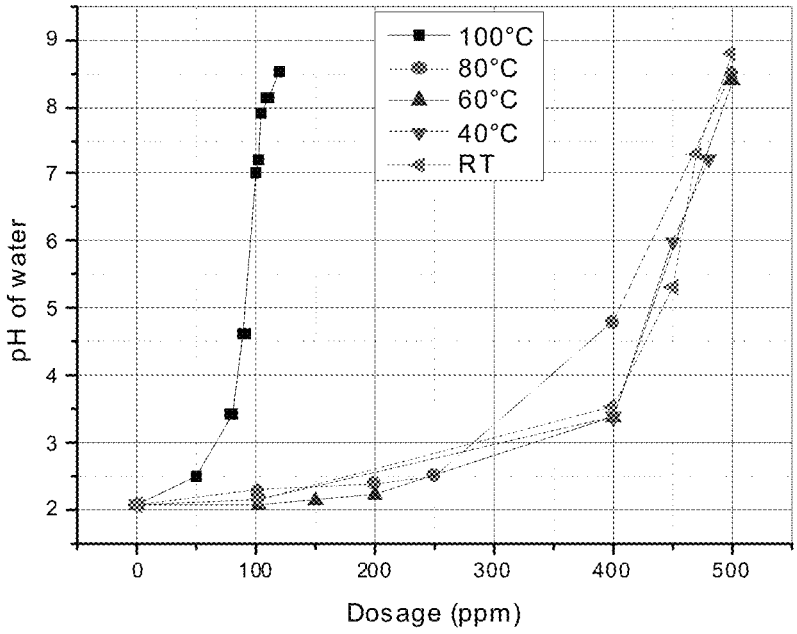
FIG. 6 is a graph illustrating neutralizing capacity of an amine composition at 200 ppm chloride concentration, at different temperatures in accordance with embodiments of the present disclosure.

FIG. 6 illustrates neutralization of water containing 200 ppm chloride concentration at different temperatures using the amine composition(s) in accordance with embodiments of the present disclosure. As shown in FIG. 6, the amine composition BPNA-5 can effectively neutralize the water condensate even at very low temperature while preventing deposits of unwanted salts on metal surfaces of the overhead equipment. Further, corrosion can be controlled even at higher dosages of the amine composition of the present disclosure.

The amine components that form part of the amine composition of the present disclosure are readily available and do not require elaborate or expensive handling procedures to meet environmental and safety concerns. The amine composition can be thermally stable at temperatures it will encounter during fractionation of crude oil. The amine composition can be volatile enough to be in the gas phase at conditions upstream of the condensation zone, and also can condense along with water in the condensing zone. Further, it can be more soluble in water than oil.

In another aspect, the present disclosure provides a method for inhibiting corrosion on internal metal surfaces of an overhead condenser of a crude distillation unit during fractionation of a mixture comprising hydrocarbons, water and amine hydrochlorides, wherein the condenser has an upper condensing zone which operates at temperatures below the water dew point of the mixture and a lower condensing zone which operates at temperatures above the water dew point of the mixture, the method comprising: adding to the condenser in the upper condensing zone an amine composition in an amount sufficient to maintain the pH of water condensate in the condenser above a pH of about 5, wherein the amine composition consisting of a mixture of monoethanloamine, methoxypropyl amine, morpholine and cyclohexylamine in a weight ratio ranges from about 10:20:40:30 to about 5:15:30:50.

In an embodiment, the method for inhibiting corrosion on internal metal surfaces of an overhead condenser of a crude distillation unit can utilize an overhead corrosion simulator to assess corrosion rate as a function of pH and chloride concentration. The overhead corrosion simulator can be conveniently and effectively used to get data such as, water condensation rate, pH/chloride concentration Vs corrosion rate and corrosion rate Vs temperature profiles.

The overhead corrosion simulator can have a liquid module, a vaporizer module and a condenser module. The liquid module can include a hydrocarbon module and an aqueous solution module and it can be configured to include a feed vessel, peristaltic pump with adjustable flow rate and an inlet and outlet tube. The flow rates of hydrocarbon and aqueous solutions can be adjusted according to the experiment requirements. The vaporizer module can have a separate module for each hydrocarbon and aqueous solutions. The temperature of the vaporizer module can be adjusted independently to attain-desired vaporization of the hydrocarbon and aqueous solutions. The condenser module can be configured to receive and condense the vapors of hydrocarbon and aqueous solutions. The condenser module can further include a provision to hang corrosion coupons at various locations and a thermowell with temperature probes for measuring the temperature of the vapors. The overhead corrosion simulator can simulate the upper trays and overhead condensing system of a crude oil distillation unit. The weights of the coupons can be measured before and after the experiment to determine the corrosion rates.

EXAMPLES

The present disclosure is further explained in the form of following examples. However, it is to be understood that the foregoing examples are merely illustrative and are not to be taken as limitations upon the scope of the invention. Various changes and modifications to the disclosed embodiments will be apparent to those skilled in the art. Such changes and modifications may be made without departing from the scope of the invention.

Example 1: Neutralization Capacity of Amine Blends (Compositions) at Varying Chloride Concentrations Different amine blends (compositions) were prepared with their composition as provided in Table-1 below and were tested against varying chloride concentrations. The results of the experiments are as illustrated in FIGS. 1, 2 and 3 for chloride concentrations of 50 ppm, 100 ppm and 200 ppm respectively.

TABLE 1

Amine Compositions

| Name | Mono-ethanloamine (vol %) | Methoxypropyl amine (vol %) | Morpholine (vol %) | Cyclo-hexylamine (vol %) |
|---|---|---|---|---|
| BPNA-1 | 5 | 30 | 45 | 20 |
| BPNA-2 | 12 | 28 | 30 | 30 |
| BPNA-3 | 30 | 25 | 30 | 15 |
| BPNA-4 | 10 | 12 | 38 | 40 |
| BPNA-5 | 36 | 31 | 16 | 17 |
| BPNA-6 | 40 | 30 | 15 | 15 |

Figure 7:
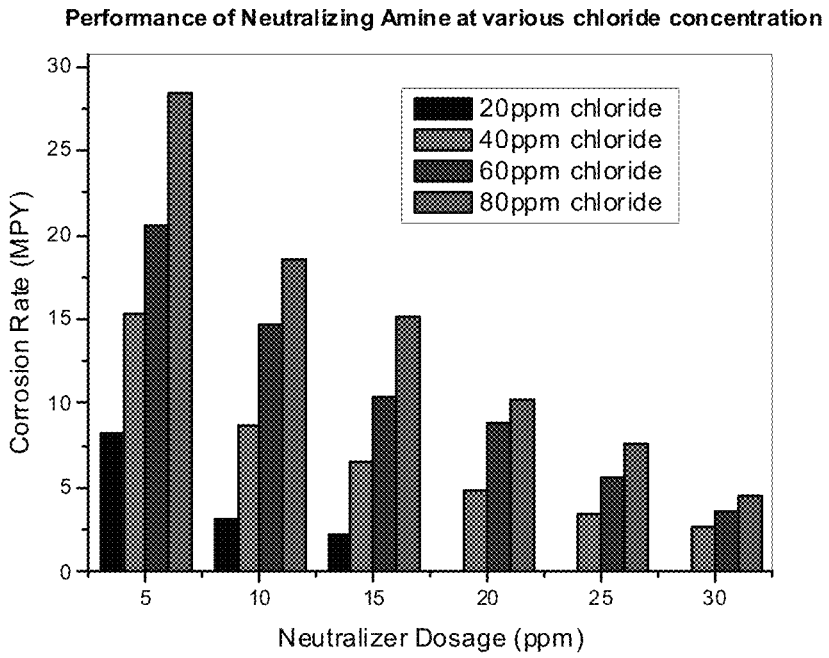
FIG. 7 is a graph illustrating corrosion rates of carbon steel at various chloride concentrations in accordance with embodiments of the present disclosure.

Example 2: Determination of Corrosion Rate (CR) at Various Chloride Concentrations of Water Condensate Effect of chloride concentration on corrosion of carbon steel was experimented using an overhead corrosion simulator, with and without addition of amine composition of the present disclosure and the results are shown in FIG. 7. Naphtha containing different concentration of chloride salts was used for the experiment. It was noticed that the corrosion rate increased with increase in chloride concentration without the presence of amine composition BPNA-5. Dosages of amine composition were optimized with respect to overhead operating conditions and chloride concentration. Further, it was observed that the corrosion rate increased with increase in chloride concentration of the water condensate. As shown in FIG. 7, addition of small amount of amine composition, for example 20 ppm for a chloride concentration of 20 ppm, decreased the corrosion rate. Further, the required amounts of amine composition for varying levels of chloride concentrations were determined and the data is provided in below Table-2.

TABLE 2

Amounts of amine composition for varying levels of chloride concentrations

| Amine | Naphtha + 20 ppm chloride | | Naphtha + 40 ppm chloride | | Naphtha + 60 ppm chloride | | Naphtha + 80 ppm chloride | |
|---|---|---|---|---|---|---|---|---|
| Dosage (ppm) | pH | CR (MPY) | pH | CR (MPY) | pH | CR (MPY) | pH | CR (MPY) |
| 0 | 3.2 | 10.97 | 2.9 | 19.45 | 2.7 | 28.55 | 2.6 | 36.45 |
| 5 | 5.2 | 8.20 | 4.3 | 15.26 | 3.9 | 20.55 | 3.5 | 28.44 |
| 8 | 5.8 | 3.16 | 5.3 | 8.65 | 4.6 | 14.66 | 3.8 | 18.55 |
| 10 | 6.1 | 2.25 | 5.8 | 6.52 | 4.8 | 10.44 | 4.2 | 15.22 |
| 15 | — | — | 6.3 | 4.89 | 5.5 | 8.88 | 5.3 | 10.21 |
| 20 | — | — | 6.2 | 3.51 | 5.9 | 5.61 | 5.9 | 7.55 |
| 25 | — | — | 6.1 | 2.65 | 6.0 | 3.55 | 5.8 | 4.52 |
| 30 | — | — | — | — | 6.3 | 2.89 | 5.9 | 3.20 |

Figure 8:
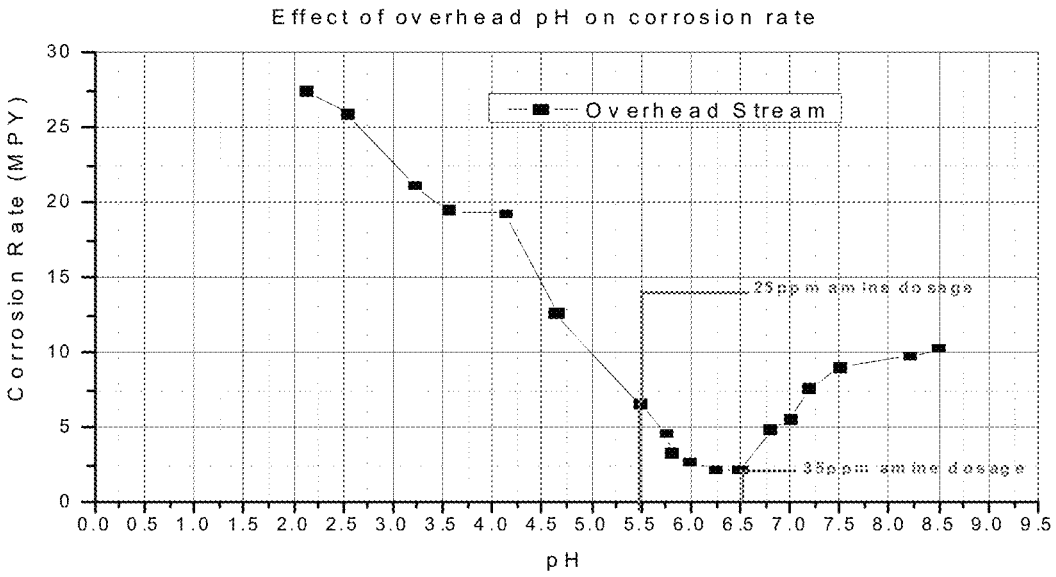
FIG. 8 is a graph illustrating corrosion rates of carbon steel at various pH concentrations and determination of optimal dosage of amine composition in accordance with embodiments of the present disclosure.

Example 3: Determination of Corrosion Rate at Various pH Levels of the Water Condensate Effect of pH on corrosion of carbon steel was experimented using an overhead corrosion simulator. Naphtha containing 40 ppm chloride was treated with 25 ppm BPNA-5 and the pH was monitored. It was observed that at lower pH (2.0-4.5) the corrosion rate was very high, but at the pH range 5.75-6.25 the corrosion rate was comparatively low. As shown in FIG. 8, the pH slowly increased and became almost stable in the range of 5.75-6.25. It was observed that 25 ppm of amine composition is optimal dosage for 40 ppm chloride solution.

Example 4 Amine Blend Test Results with Variation of Acid Strength

Effectiveness of amine blends, realized in accordance with embodiments of the present disclosure, was checked against different acid strengths i.e. against 0.0001N HCl and against 0.001N HCl. The results of the experiment are as provided in the Table 3 below. It could be observed that the amine blends, realized in accordance with embodiments of the present disclosure, are effective against varying acid strengths.

TABLE 3

Effectiveness of amine blends against different acid strengths

| | Acid strength | | | | | |
|---|---|---|---|---|---|---|
| | 0.0001N HCl | | | 0.001N HCl | | |
| Amine | Dosage | pH | | Dosage | pH | |
| blend | (ppm) | Before | After | (ppm) | Before | After |
| BPNA-5 | 5 | 3.8 | 6.4 | 5 | 2.5 | 6.4 |
| | 8 | 3.8 | 7.0 | 8 | 2.5 | 7.0 |
| BPNA-4 | 10 | 3.8 | 6.5 | 10 | 2.5 | 6.5 |
| | 17 | 3.8 | 7.0 | 17 | 2.5 | 7.0 |

Example 5: Electrochemical Data of Amine Blend

Working electrodes of carbon steel cylindrical sample with resinous material in between reference and working electrode was used after polishing with 1/0 to 4/0 of emery papers. The specimens were then washed with distilled water and finally degreased with trichloroethylene. A platinum foil was used as auxiliary electrode. All the experiments were carried out at constant temperature of 30±1° C. and at a scan rate of 1 mV/sec at open circuit potential. The polarization curves were recorded after immersion of the electrode in the solution for 30 minutes (until steady state is reached).

The cathodic and anodic polarization curves were obtained for mild steel in 1.0 mol dm-3 in the absence and presence of the system containing naphtha+acidic impurities, with and without corrosion inhibitor and amine blend BPNA-5.

Electrochemical parameters such as corrosion current density ($I_{corr}$), corrosion potential ($E_{corr}$) and inhibition efficiency (IE) were calculated from Tafel plots. The values of Icorr decreased significantly in the presence of good inhibition system. The presence of amine blend with inhibitor did not exhibit any significant change in $E_{corr}$ values suggesting that these compounds behaves as mixed type inhibitors i.e., they retard the corrosion reaction by blocking both anodic and cathodic sites of the metal.

TABLE 4

Electrochemical polarization parameters for the corrosion of mild steel in HCl containing amines in system

| System | $E_{corr}$ (mV) | $I_{corr}$ (mA $cm^{-2}$) | IE (%) |
|---|---|---|---|
| 1N HCl | −461 | 0.360 | — |
| 1N HCl + BPNA-5 | −480 | 0.033 | 90.83 |
| 1N HCl + BPNA-3 | −476 | 0.056 | 84.44 |

Example 6: Refinery Plant Trial

The trials of BPNA-5 were conducted at two different refineries, i.e. refinery-1 and refinery-2. Crude-1 was processed in refinery-1 and Crude-2 was processed in refinery-2. The typical properties of crude oils are shown in Table-5 below. The desalter conditions are provided in Table 6 below.

TABLE 5

Crude oil properties

| Properties | Crude-1 | Crude-2 |
|---|---|---|
| Density at 15° C., kg/m3 | 830.2 | 872.9 |
| °API | 38.9 | 30.6 |
| Acidity, mg KOH/g | 0.10 | 0.14 |
| Sulphur, wt % | 0.09 | 2.80 |
| Viscosity, cSt (at 40° C.) | 3.4 | 11.1 |
| Pour Point, ° C. | 30.0 | −27.0 |
| Wax, wt % | 11.8 | 6.0 |

TABLE 6

Desalter Performance

| | Refinery-1 | Refinery-1 |
|---|---|---|
| Desalter inlet | | |
| Salt content in crude oil, ptb | 2.6 | 2.0 |
| BS&W, % | 0.10 | 0.05 |
| Wash water pH | 9.0 | 7.5 |
| Chloride, ppm (in wash water) | 7.1 | 11.0 |
| Desalter outlet | | |
| Salt content in crude oil, ptb | 0.37 | 0.80 |
| BS&W, % | 0.10 | 0.20 |
| Brine pH | 8.6 | 6.5 |
| Chloride, ppm (in brine) | 173.0 | 120 |

BPNA-5 as shown in Table-1, was injected in atmospheric column overhead of refinery-1 and refinery-2 to neutralize the acidic environment. Condensed water from naphtha accumulator boot was collected and analyzed. The ppm dosage of BPNA-5 was calculated on the basis of total column overhead flow rate. The performance of BPNA-5 is provided in Table 7 below.

TABLE 7

| BPNA-5 plant trial performance | | | |
|---|---|---|---|
| Refinery-1 | | Refinery-2 | |
| BPNA-5 dosage, ppm | pH (Naphtha accumulator boot water) | BPNA-5 dosage, ppm | pH (Naphtha accumulator boot water) |
| 2.3 | 5.5 | 2.3 | 5.5 |
| 2.4 | 5.7 | 2.5 | 5.8 |
| 2.5 | 5.8 | 2.8 | 5.9 |
| 2.7 | 6.0 | 3.0 | 6.0 |
| 2.9 | 6.2 | 3.2 | 6.3 |
| 3.0 | 6.4 | 3.5 | 6.5 |

Advantages of the Present Invention

The present disclosure provides an improved neutralizing agent capable of neutralizing acidic components while not permitting the resulting amine salt to deposit on overhead condensing equipment surfaces.

The present disclosure provides a neutralizing agent that eliminates or reduces fouling of overhead condensing system and thereby reduces system down time and productivity loss due to cleaning and/or replacing fouled equipment.

The present disclosure provides a neutralizing agent that is highly effective and it requires less quantity to increase the pH of the water condensate to corrosion-safe level compared to known neutralizing agents.

The present disclosure provides an improved neutralizing agent that can be formulated using readily available amines.

The present disclosure provides a method for inhibiting corrosion in overhead condensing system of distillation columns that is simple, reliable and highly economic.

The present disclosure provides a method for inhibiting corrosion in overhead condensing system using an overhead corrosion simulator that facilitates optimization of overhead operating parameters such as neutralizing agent dosing rate and corrosion rate more accurately.

The present disclosure provides a method for inhibiting corrosion in overhead condensing system of distillation columns which obviates the disadvantages associated with the known art.

We claim:

1. A method for inhibiting corrosion on internal metal surfaces of an overhead condenser of a crude distillation unit, the method comprising: adding to the overhead condenser an amine composition in an amount and at a rate sufficient to maintain pH of water condensate in the condenser above a pH of about 5, the amine composition consisting of monoethanloamine, methoxypropyl amine, morpholine and cyclohexylamine.

2. The method of claim 1, wherein the amine composition consists of monoethanloamine, methoxypropyl amine, morpholine and cyclohexylamine in a weight ratio ranging from about 25:30:25:20 to about 30:40:15:15.

3. The method of claim 1, further comprising the step of using an overhead corrosion simulator to assess corrosion rate as a function of pH and chloride concentration.

4. The method of claim 1, further comprising the step of using an electrochemical method for prediction of corrosion rate.

5. The method of claim 1, wherein the amount of the amine composition ranges from about 1 to about 10,000 ppm based on an amount of the water condensate.

6. A method for inhibiting corrosion on internal metal surfaces of an overhead condenser of a crude distillation unit during fractionation of a mixture comprising hydrocarbons, water and amine hydrochlorides, the condenser defining an upper condensing zone operating at temperatures below water dew point of the mixture and a lower condensing zone operating at temperatures above the water dew point of the mixture, the method comprising:

adding to the condenser in the upper condensing zone an amine composition in an amount sufficient to maintain pH of water condensate in the condenser above pH of about 6.5 to 7.0, the amine composition consisting of monoethanloamine, methoxypropyl amine, morpholine and cyclohexylamine in a weight ratio ranging from about 25:30:25:20 to about 30:40:15:15.

7. The method of claim 6, further comprising the step of using an overhead corrosion simulator to assess corrosion as a function of pH and chloride concentration.

8. The method of claim 6, further comprising the step of using an electrochemical method for prediction of corrosion rate.

9. The method of claim 6, wherein the amount of amine composition ranges from about 1 to about 10,000 ppm based on an amount of the water condensate.

* * * * *